US005547182A

United States Patent [19]

Murphy, III

[11] Patent Number: 5,547,182

[45] **Date of Patent: * Aug. 20, 1996**

[54] APPARATUS FOR FEEDING DISTORTED DOCUMENTS

[76] Inventor: Charles F. Murphy, III, 236 Second Ave., Milford, Conn. 06460

[ * ] Notice: The term of this patent shall not extend beyond the expiration date of Pat. No. 5,409,206.

[21] Appl. No.: 292,698

[22] Filed: Aug. 19, 1994

[51] Int. Cl.[6] ..... B65H 29/42

[52] U.S. Cl. ..... 271/179; 198/663; 271/184; 101/424.1; 400/625; 347/102

[58] Field of Search ..... 271/69, 225, 177, 271/178, 179, 184; 400/625; 101/424.1; 198/663; 347/102; 221/75

[56] References Cited

U.S. PATENT DOCUMENTS

| | | | |
|---|---|---|---|
| 1,107,556 | 8/1914 | Turck . | |
| 2,048,870 | 7/1936 | Kannee | 271/179 |
| 2,752,696 | 7/1956 | Black | 34/149 |
| 2,795,702 | 6/1957 | Morris | 221/75 |
| 3,280,679 | 10/1966 | Huffman | 271/179 |
| 4,058,908 | 11/1977 | Weber | 34/149 |
| 4,270,747 | 6/1981 | Templeton | 271/179 |
| 4,547,114 | 10/1985 | Watrous et al. | 271/179 |
| 5,409,206 | 4/1995 | Marzullo et al. | 271/179 |

FOREIGN PATENT DOCUMENTS

| | | | |
|---|---|---|---|
| 541896 | 6/1957 | Canada | 271/179 |
| 0034851 | 2/1989 | Japan | 271/179 |

*Primary Examiner*—H. Grant Skaggs

[57] ABSTRACT

An apparatus for buffering transport of inked, distorted documents is comprised of an upper deck oriented at an acute angle. The apparatus has a plurality of opposite, parallel, threaded screw conveyers orthogonal to the upper deck. The screw conveyers are positioned in close proximity to provide a support surface for an inked document fed into the buffer apparatus. The individual threads of the screw conveyers are adapted to simultaneously support, advance, and lower the individual sheets incident to rotation of the respective screw conveyers thereby depositing the inked, distorted documents successively onto lower threads. A lower deck is provided for receiving inked documents.

3 Claims, 4 Drawing Sheets

APPARATUS FOR FEEDING DISTORTED DOCUMENTS

BACKGROUND OF THE INVENTION

The present invention relates to document feeding, and, in particular, to an apparatus in which paper or other such documents with curled or dog-eared edge are fed one at a time onto a document supporting surface.

For increasing the throughput of mailing machines, it is important to provide means for buffering transport of inked documents exiting a liquid ink printer, such as an ink jet printer, so that the ink is relatively dry upon the document and will not smear. This presents a problem of storing the documents during the drying period without leading to stoppages in the operation of the transport and in turn halting operation of the entire mailing system. Heretofore, it has been the practice to extend the path of travel for documents to enable sufficient drying time prior to further manipulation of the document. Machines for drying articles, such as printed material, have often consisted of a long, substantially horizontal, conveyor belt on which articles to be dried are placed. A disadvantage of this type of machine is that, since they are longitudinally oriented, extending the path utilizes valuable space and consumes much time. U.S. Pat. No. 5,409,206 entitled APPARATUS FOR BUFFERING TRANSPORT OF DOCUMENT, assigned to the assignee of the instant patent application, describes a buffer apparatus for handling a continuous flow of freshly inked sheets at a high input rate. Although this arrangement worked satisfactorily, the present inventor found that the buffer apparatus experienced problems receiving bent, warped, or otherwise physically deformed inked documents. Generally, a document handler can only be reliably used if the documents are in relatively good condition and without folds or a large amount of curl. Consequently, feeding a document in the aforementioned system may result in misalignment, smeared ink, or a jam. For the foregoing reasons, there is a need for a buffet apparatus which can feed a deformed document without stopping or diverting the moving document, and without requiring any operator intervention.

SUMMARY OF THE INVENTION

The present invention is intended to obviate or eliminate the disadvantages and problems discussed above. In its broader aspects, the present invention is to an apparatus for buffering transport of a distorted document wherein the apparatus is adapted to handle a continuous flow of fleshly inked sheets at a high rate. An apparatus having features of the present invention comprises an upper deck oriented at an acute angle. The upper deck has an outer surface and a recessed substantially planar inner surface. The apparatus has a plurality of opposite, parallel, threaded screw conveyers orthogonal to the upper deck. The plurality of screw conveyers are spaced apart a predetermined distance The plurality of screw conveyers have a top shrouded by the inner surface. The apparatus has a lower deck located beneath the plurality of screw conveyers with means for ejecting the document horizontally from the apparatus along the lower deck.

BRIEF DESCRIPTION OF THE DRAWINGS

These and other objects and advantages of the present invention will become apparent from the following description of the accompanying drawings. It is to be understood that the drawings are to be used for the purpose of illustration only, and not as a definition of the invention.

In the drawings.

DESCRIPTION OF THE PREFERRED EMBODIMENT

Figure 1:
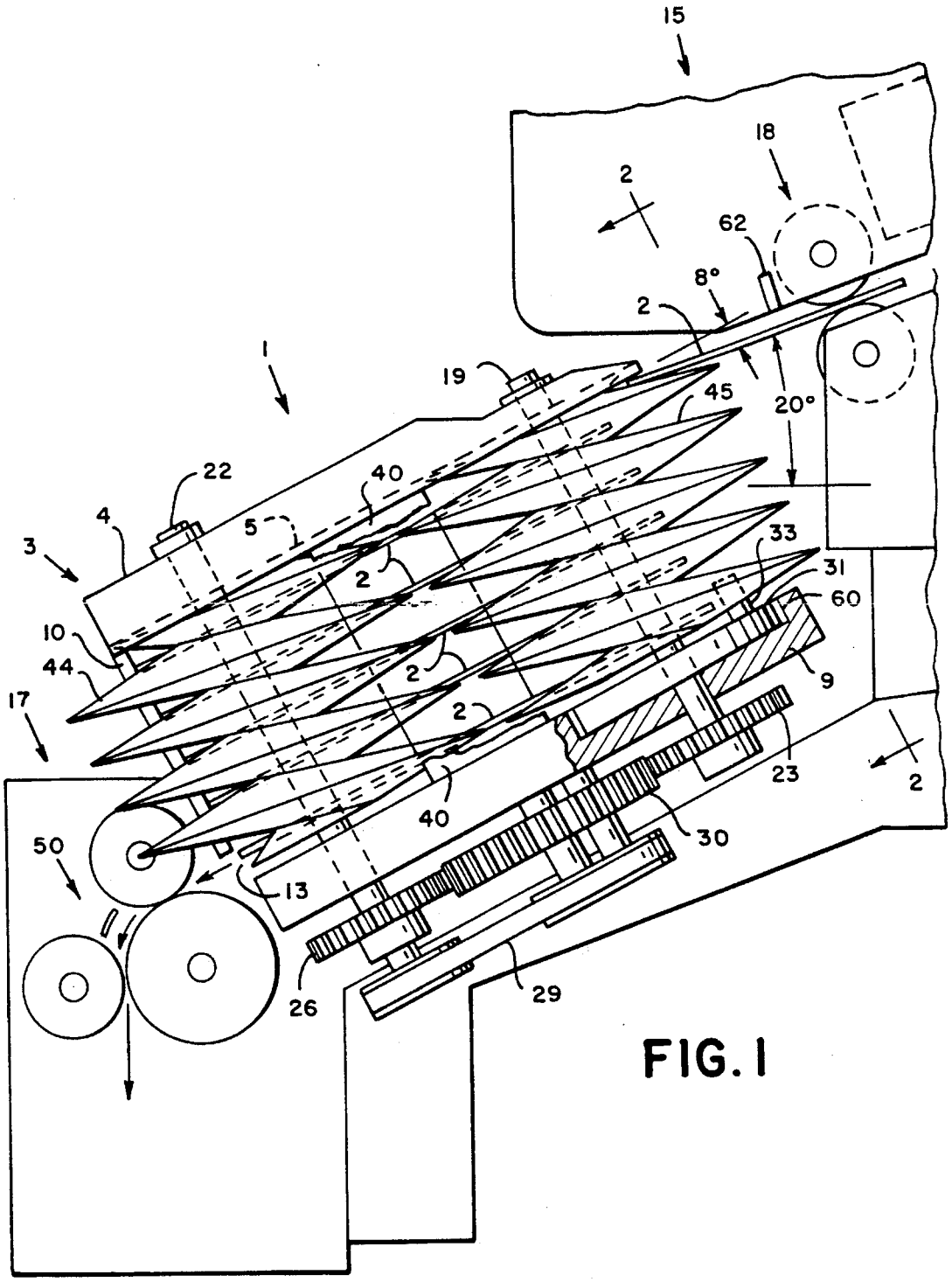
FIG. 1 is a side elevational view of the apparatus.

FIG. 1 shows an apparatus I suitable for buffering the transport of a series of documents 2, such as those coming from a printer 15. The printer 15 is preferably a conventional, stand-alone device. The printer 15 includes conventional printing structure, such as any conventional thermal, ink jet, or other commercially available printing apparatus, to which the documents 2 are fed. In addition, the printer 15 includes a conventional feeding structure. The feeding structure may be any conventional roller-type structure for engaging and feeding the documents 2, including a roller 18 for feeding documents 2 from the printer 15.

The apparatus 1 comprises an upper deck 3, oriented at an acute angle with respect to a horizontal plane, a lower deck 9, mid a rear guide 10. The rear guide 10 is fixably mounted to the upper deck 3, extending generally perpendicular to and along one side of file upper deck 3. The apparatus 1 has a slit 13 between the rear guide 10 and the lower deck 9. The apparatus may eject documents 2.by passing the documents 2 through the slit 13, into a conventional document handler 17 such as an envelope flapper, document folder, or inserter. The document handler 17 includes a conventional feeding structure. The feeding structure may be any conventional roller-type structure for engaging and feeding the documents 2, including a roller 50 for feeding documents 2 into the document handler 17.

Figure 2:
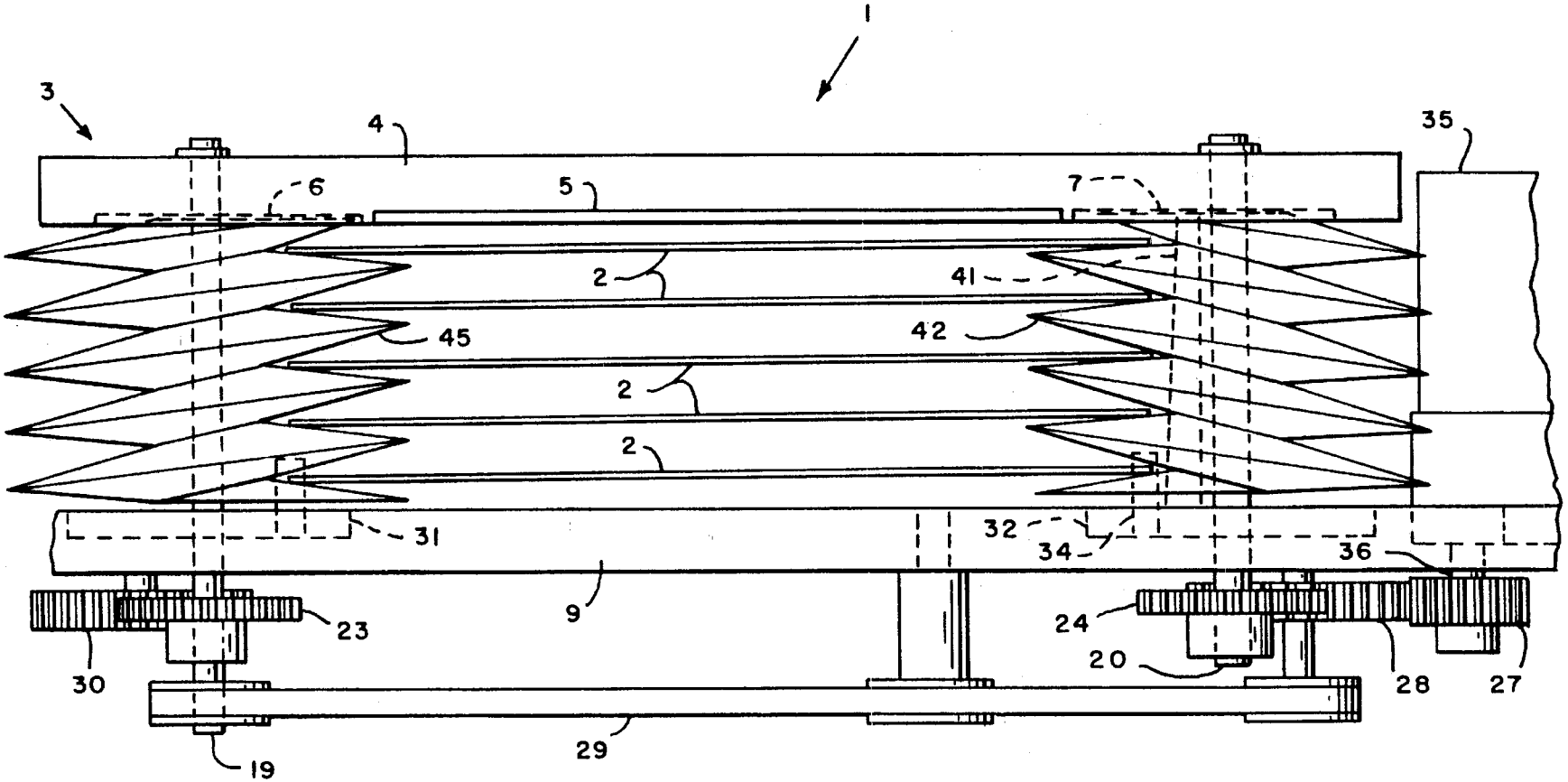
FIG. 2 is a vertical section on the line 2—2, FIG. 1.

Referring to FIGS. 1 and 2, the upper deck 3 comprises an outer surface 4 and a recessed, substantially planar inner surface 5. The recessed inner surface 5 provides sufficient clearance for the documents 2 so that surface ink will not smear during transport. Tapered guides 40 and 41, opposite and parallel, extend vertically between the upper deck 3 and lower deck 9.

Figure 3:
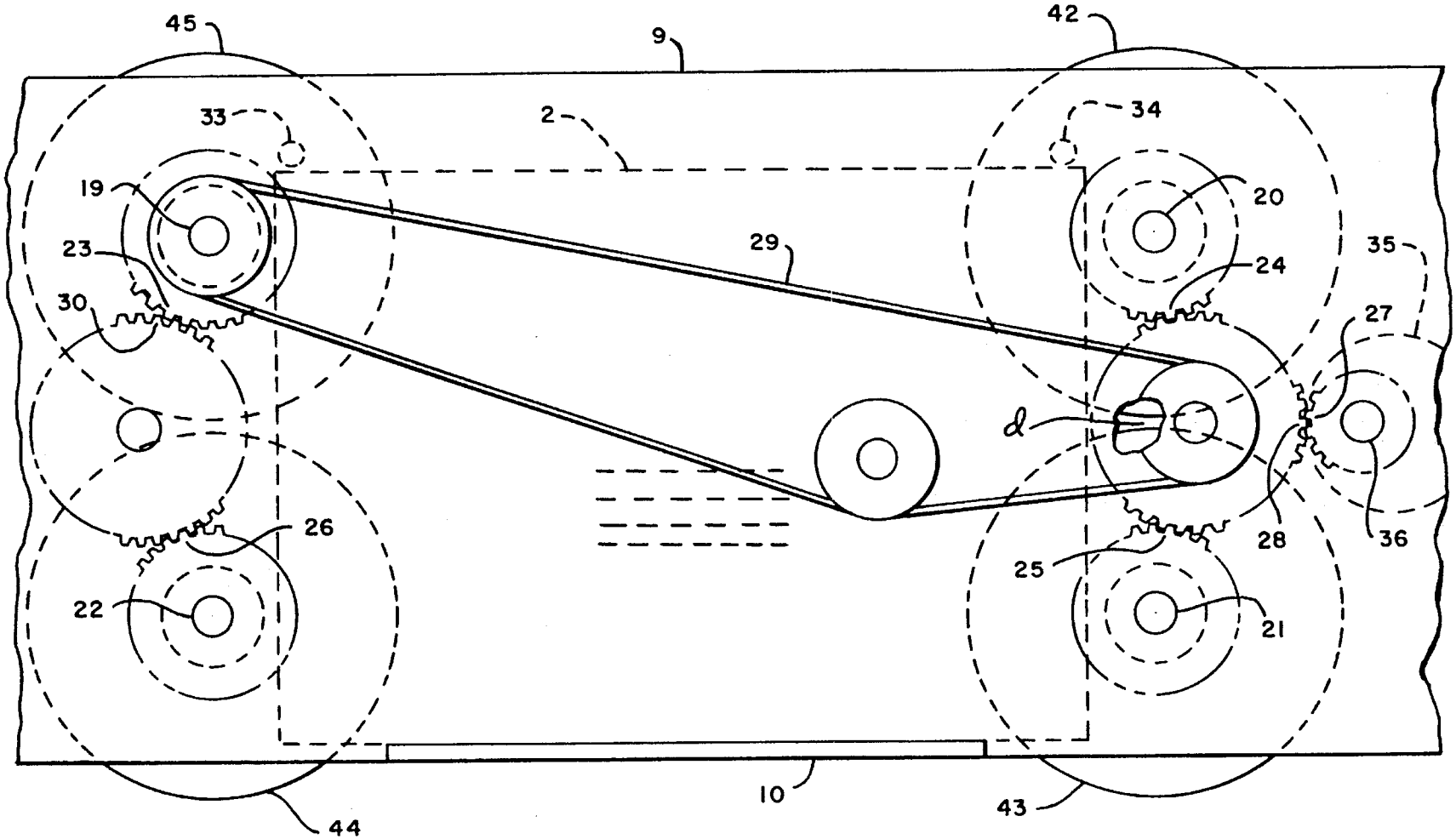
FIG. 3 is a bottom view of the apparatus.

Referring to FIGS. 2 and 3, a plurality of vertically disposed, opposite, parallel, threaded screw conveyers 42, 43, 44, and 45 are orthogonal to the upper deck 3. The screw conveyers 42, 43, 44, and 45 are mounted apart an appropriate distance to permit the edges or other suitable projection of documents 2 to engage in the threads of these conveyers 42, 43, 44, and 4S. The screw conveyers are threaded to like pitch and oppositely, screw conveyers 42 and 43 being left hand and screw conveyers 44 and 45 being right hand. In the preferred embodiment, the threads of left hand screw conveyers 42, 43 are spaced apart a predetermined distance d which is at least 0.020 inches but no more than 0.1 inches. The threads of right hand screw conveyers 44, 45 are spaced apart the same distance d. Each screw conveyer 42, 43, 44, and 45 has an approximate 2 inch diameter. The thread depth of screw conveyers 42, 43, 44, and 45 is approximately 0.48 inch±0.01 inch.

Figure 4:
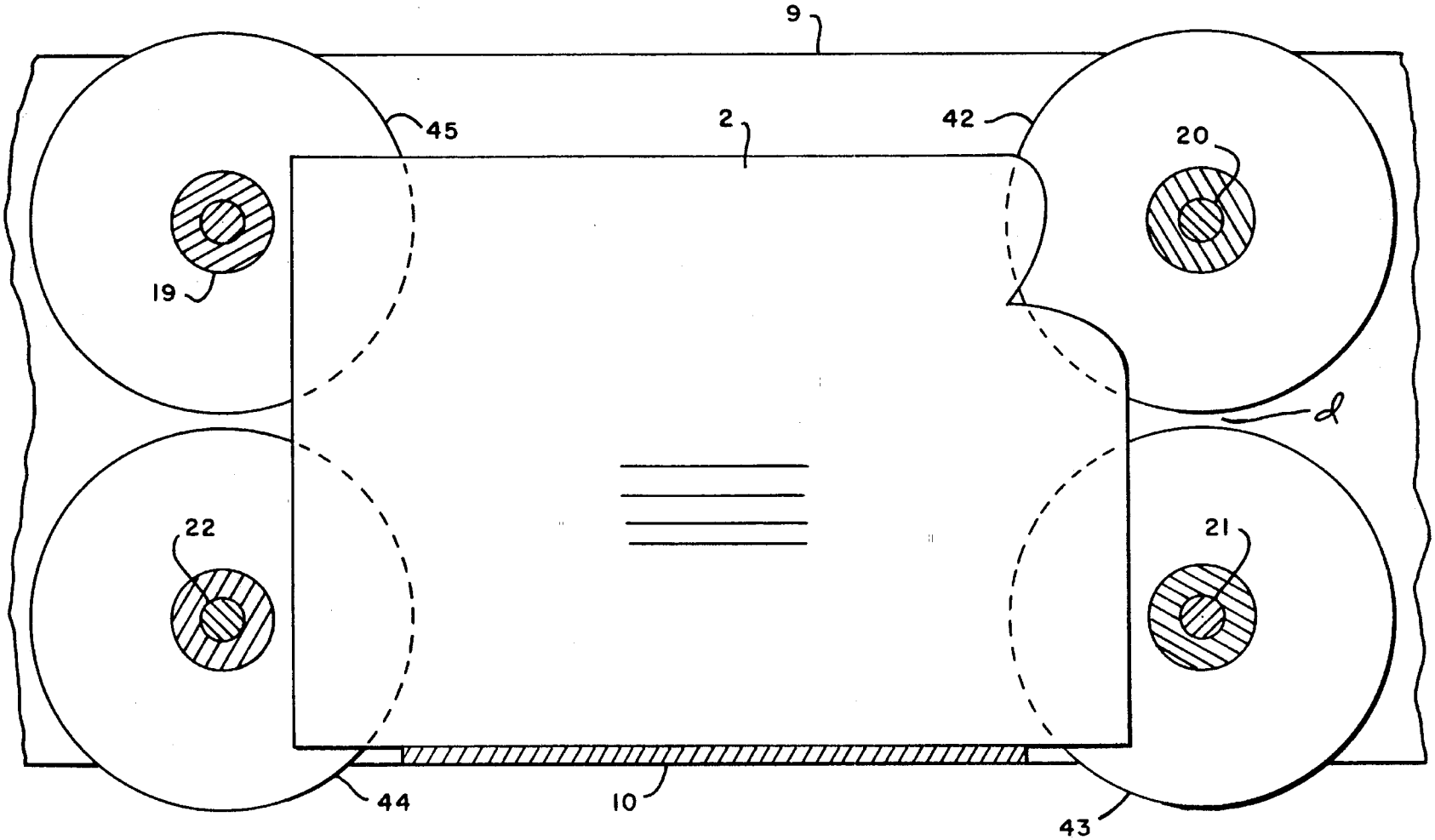
FIG. 4 shows an enlarged, partial elevation of the apparatus containing a deformed envelope.

As can be seen from FIG. 4, one of the front comers of document 2 is dog-eared. A jam may occur if the dog-eared comer fails to come into contact with the uppermost thread of screw conveyers 42, 43, 44, and 45. To enable the document 2 to be fed onto the uppermost thread of screw conveyers 42, 43, 44, and 45 without becoming jammed, the threads of threaded screw conveyer pairs 42, 43 and 44, 45 are spaced apart a predetermined distance d which is at least 0.020 inch. It will be appreciated that although the document 2 shown in FIG. 4 is dog-cared at one leading comer, the screw conveyers 42, 43, 44, and 45 will be equally effective on a document 2 that is dog-eared at both corners and on a document 2 which has turned-up corners because it is curled.

The inner surface 5 of the upper deck 3 shrouds the top 7 of each screw conveyer 42, 43, 44, and 45. The screw conveyers 42, 43, 44, and 45 are fixably mounted onto shafts 19, 20, 21, 22. The shafts 19, 20, 21, and 22 are rotatively mounted at one end to the upper deck 3. At the other end, the shafts 19, 20, 21, and 22 extend through the lower deck 9. Underneath the lower deck 9, gears 23, 24, 25, 26 are fixably mounted onto the shafts 19, 20, 21, and 22.

Referring to FIGS. 1 and 2, recessed disks 31 and 32 are fixably mounted onto shafts 19 and 20. The recessed disks 31 and 32 are set in a recess 60 and can be flush with the surface of the lower deck 9. Fixably mounted on each recessed disk 31 and 32 are vertically extending eject pins 33 and 34. The eject pins 33 and 34 assume a generally perpendicular orientation with respect to the lower deck 9.

Referring to FIG. 3, a motor 35 is mounted on the lower deck 9. The motor 35 has a shaft 36 on which is mounted a gear 27 which is in drive communication with an idler gear 28. The idler gear 28 is adapted to mesh with and drive gears 24 and 25 thereby imparting rotation to threaded screw conveyers 42 and 43. The idler gear 28 transmits motion to gear 23 by means of belt 29 thereby impaling rotation to threaded screw conveyer 45. Gear 23 transmits motion to gear 26 by means of idler gear 30, thereby imparting rotation to threaded screw conveyer 44.

In the embodiment of the invention as illustrated in FIGS. 1 to 3, a printer 15 prints information on documents 2 including a mailing address, bar code, or indicia. The printer transports inked documents 2 through feed roller 18 lead edge first. The upper deck 3 is oriented at an acute angle with respect to the printer 15 horizontal, preferably an approximate twenty degree angle. To overcome the natural curling action of documents 2 under the influence of the atmosphere, the documents 2 may be fed into the recessed tinier surface 5 at an approximate eight degree angle. This feeding action bends the documents 2 thereby flattening the lead edge. The recessed tinier surface 5 provides sufficient clearance so that the inked documents 2 will not smear during conveyance from the printer 15 to the apparatus 1. The documents 2 engage between the upper deck 3 and the uppermost threads of screw conveyers 42 and 45.

The top 7 of screw conveyers 42, 43, 44, and, 45 lie above the inner surface 5 thereby ensuring the documents 2 fall within the pitch of screw conveyers 42, 43, 44, and 45. The individual thread plates of screw conveyers 42, 43, 44, and 45 are adapted to simultaneously support, advance, and lower the documents 2 incident to rotation of threaded screw conveyers 42, 43, 44, and 45 thereby depositing the document 2 successively onto the lower threads. Each pitch of screw conveyers 42, 43, 44, and 45 creates a drying station for inked documents 2. In the preferred embodiment, there are five pitches per screw conveyer 42, 43, 44, and 45 having an approximate allotted drying time of four seconds per document. The drying time may be increased or decreased by changing the software parameters controlling the number of screw conveyer 42, 43, 44, and 45 revolutions per second.

The roller 18 feeds the documents 2 until a sensor 62 detects the trail edge exiting the printer 15. At that time, the lead edge abuts rear guide 10 and rests on screw conveyers 43 and 44; the trail edge rests on screw conveyers 42 and 45. After the sensor 62 detects the trail edge exiting the printer 15, the motor 35 rotates thereby imparting motion to the screw conveyers 42, 43, 44, and 45. As the screw conveyers 42, 43, 44, and 45 rotate, tapered guides 40 and 41 center the documents 2 traveling downward along the threads to the next pitch of screw conveyers 42, 43, 44, and 45.

At the lowest drying station in the apparatus 1, eject pins 33 and 34 engage the trail edge of the document 2 as the document 2 leaves screw conveyers 42 and 45 thereby advancing the document 2 forward through slit 13 a predetermined distance wherein the lead edge of the document 2 is buckle registered into the nip of roller 50. The trail edge of documents 2 may rise above eject pins 33 and 34 thereby impairing ejection of the documents 2 frown the apparatus 1. Hence, the eject pins 33 and 34 may include means for keeping the documents 2 flush with the lower deck 9.

The afore description is of the preferred embodiment of the present invention and should not be viewed as limiting to the invention. It will be understood that numerous details may be altered or omitted without departing from the spirit of the invention. The scope of the invention is defined by the following claims.

What is claimed is:

1. An improved apparatus for buffering transport of a document of the type in which an upper deck has an outer surface and a recessed substantially planar surface, and in which a lower deck is positioned below the upper deck, the improvement comprising:

means for transporting a distorted document, the means comprising a plurality of opposite, parallel, threaded screw conveyers for feeding the document orthogonal to the upper deck, the recessed substantially planar surface extending beyond the axis of the threaded screw converters towards the incoming document, the plurality of screw conveyers spaced in close proximity to the feed direction of the preceding conveyer to allow transport of the distorted document without jamming.

2. The apparatus of claim 1 wherein the plurality of screw conveyers have a predetermined thread depth, the depth being selected to allow transport of the distorted document without jamming.

3. A method of buffering transport of a distorted document, the method comprises:

a) feeding the distorted document onto a plurality of threaded screw conveyers and a recessed substantially planar surface extending beyond the axis of the threaded screw converters towards the incoming document in close proximity to the feed direction of the preceding screw conveyer so that a document will not be able to slip between the threads of the preceding and subsequent screw conveyers;

b) rotating the screw conveyers; and, c) transporting the distorted document to a subsequent thread of the screw conveyers without causing an error condition.

* * * * *

UNITED STATES PATENT AND TRADEMARK OFFICE

CERTIFICATE OF CORRECTION

PATENT NO. : 5,547,182

DATED : August 20, 1996

INVENTOR(S) : Charles F. Murphy, III

It is certified that error appears in the above–identified patent and that said Letters Patent are hereby corrected as shown below:

On the title page:

After "[76] Inventor: Charles F. Murphy, III, 236 Second Ave., Milford, Conn 06460" on next line add--[75] Assignee: Pitney Bowes Inc., Stamford, Conn.

Column 1, line 40, please change "buffet" to --buffer,--,

Column 1, line 56, after "distance" please add --.--.

Column 2, line 27, please delete "mid" and substitute --and--,

Column 2, line 29, please delete "file" and substitute --the--,

Column 2, line 31, after "2" delete --.--,

Column 2, line 53, delete "4S" and substitute "45".

UNITED STATES PATENT AND TRADEMARK OFFICE

CERTIFICATE OF CORRECTION

PATENT NO. : 5,547,182

DATED : August 20, 1996

INVENTOR(S) : Charles F. Murphy, III

It is certified that error appears in the above-indentified patent and that said Letters Patent is hereby corrected as shown below:

Column 3, line 6, change "cared" to --eared--,

Column 3, line 31, delete "impaling" and replace with --imparting--,

Column 3, line 44, delete "tinier" and replace with --inner--,

Column 3, line 47, delete "tinier" and replace with --inner--,

Column 3, line 52, after "and" delete --;--.

Column 4, line 20, delete "frown" and substitute --from--,

Signed and Sealed this

First Day of April, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,547,182

DATED : August 20, 1996

INVENTOR(S) : Charles F. Murphy, III

It is certified that error appears in the above-indentified patent and that said Letters Patent is hereby corrected as shown below:

TITLE PAGE:

After "[76] Inventor: Charles F. Murphy, III, 236 Second Ave., Milford, Conn 06460" on next line add --[73]Assignee Pitney Bowes Inc., Stamford, Conn.

Column 1, line 40, please change "buffet" to --buffer,--.

Column 1, line 56, after "distance" please add --.--.

Column 2, line 27, please delete "mid" and substitute --and--.

Column 2, line 29, please delete "file" and substitute --the--.

Column 2, line 31, after "2" delete --.--.

Column 2, line 53, delete "4S" and substitute --45--.

Column 3, line 6, change "cared" to --eared--.

Column 3, line 31, delete "impaling" and replace with --imparting--.

Column 3, line 44, delete "tinier" and replace with --inner--.

Column 3, line 47, delete "tinier" and replace with --inner--.

Column 3, line 52, after "and" delete --,--.

UNITED STATES PATENT AND TRADEMARK OFFICE

CERTIFICATE OF CORRECTION

PATENT NO. : 5,547,182

DATED : August 20, 1996

INVENTOR(S) : Charles F. Murphy, III

It is certified that error appears in the above-indentified patent and that said Letters Patent is hereby corrected as shown below:

Column 4, line 20, delete "frown" and substitute --from--.

This Certificate supersedes Certificate of Correction issued April 1, 1997.

Signed and Sealed this

Fifth Day of August, 1997

Bruce Lehman

*Attest:*

BRUCE LEHMAN

*Attesting Officer*

*Commissioner of Patents and Trademarks*